US009925809B2

(12) United States Patent
Tanami

(10) Patent No.: US 9,925,809 B2
(45) Date of Patent: Mar. 27, 2018

(54) ROLL-UP APPARATUS

(71) Applicant: CANON KABUSHIKI KAISHA, Tokyo (JP)

(72) Inventor: Haruhiko Tanami, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/242,909

(22) Filed: Aug. 22, 2016

(65) Prior Publication Data

US 2017/0072719 A1 Mar. 16, 2017

(30) Foreign Application Priority Data

Sep. 11, 2015 (JP) ..... 2015-180114

(51) Int. Cl.
*B41J 15/16* (2006.01)
*B65H 23/18* (2006.01)

(52) U.S. Cl.
CPC ..... *B41J 15/16* (2013.01); *B65H 23/1806* (2013.01); *B65H 2403/942* (2013.01); *B65H 2801/12* (2013.01)

(58) Field of Classification Search
CPC ..... B41J 15/00; B41J 15/16; B65H 23/18; B65H 23/1806; B65H 23/1813; B65H 23/182; B65H 23/1825; B65H 23/185; B65H 23/188; B65H 23/1888; B65H 23/192; B65H 23/195; B65H 23/1955; B65H 23/198; B65H 2403/942
See application file for complete search history.

(56) References Cited

U.S. PATENT DOCUMENTS

| | | | | |
|---|---|---|---|---|
| 9,334,137 | B2 | 5/2016 | Igarashi et al. | |
| 2012/0263514 | A1 | 10/2012 | Tanami et al. | |
| 2016/0207333 | A1 | 7/2016 | Igarashi et al. | |
| 2016/0229201 | A1* | 8/2016 | Takenaka | B41J 11/00 |

FOREIGN PATENT DOCUMENTS

| | | | |
|---|---|---|---|
| JP | 2011-011889 | A | 1/2011 |
| JP | 2012-236305 | A | 12/2012 |

* cited by examiner

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

A roll-up apparatus for rolling up a continuous sheet into a roll shape, comprises a tension generation unit configured to generate a changeable tension to the continuous sheet; and a control unit configured to control the tension generation unit based on a roll-up condition of the continuous sheet.

12 Claims, 10 Drawing Sheets

| | ROLL-UP DIRECTION | OPERATION MODE | REFERENCE ROLL-UP ROTATION FORCE SETTING VALUE | LOCK CANCELING ROTATION FORCE SETTING VALUE | REFERENCE STANDBY ROTATION FORCE SETTING VALUE |
|---|---|---|---|---|---|
| SHEET TYPE INFORMATION 1 | OUTER ROLL-UP | ASYNCHRONOUS CONTROL MODE | A | 0 | 0 |
| | INNER ROLL-UP | ASYNCHRONOUS CONTROL MODE | D | E | F |
| SHEET TYPE INFORMATION 2 | OUTER ROLL-UP | SYNCHRONOUS CONTROL MODE | G | H | I |
| | INNER ROLL-UP | SYNCHRONOUS CONTROL MODE | J | K | L |

FIG. 11

| | ROLL-UP DIRECTION | OPERATION MODE | REFERENCE ROLL-UP ROTATION FORCE SETTING VALUE | LOCK CANCELING ROTATION FORCE SETTING VALUE | REFERENCE STANDBY ROTATION FORCE SETTING VALUE |
|---|---|---|---|---|---|
| SHEET TYPE INFORMATION 1 | OUTER ROLL-UP | ASYNCHRONOUS CONTROL MODE | A | 0 | 0 |
| | INNER ROLL-UP | ASYNCHRONOUS CONTROL MODE | D | E | F |
| SHEET TYPE INFORMATION 2 | OUTER ROLL-UP | SYNCHRONOUS CONTROL MODE | G | H | I |
| | INNER ROLL-UP | SYNCHRONOUS CONTROL MODE | J | K | L |

ROLL-UP APPARATUS

BACKGROUND OF THE INVENTION

Field of the Invention

The present invention relates to a roll-up apparatus.

Description of the Related Art

A sheet conveyance apparatus for conveying a sheet by a conveyance roller is required to stably perform a roll-up operation when rolling up a roll sheet. In a large-format printing apparatus disclosed in Japanese Patent Laid-Open No. 2012-236305, a roll-up apparatus is arranged on the downstream side of a printhead to roll up a roll sheet fed by a sheet conveyance roller. To convey the long continuous sheet without causing a distortion or wrinkle, a feed roller pair is provided on the upstream side of the print position in the medium conveyance direction, and a tension roller is provided on the downstream side. The tension roller can adjust a tension to be applied to the sheet.

In a medium conveyance mechanism disclosed in Japanese Patent Laid-Open No. 2011-11889, when the roll-up amount of a sheet that is fed from a printer and rolled up around a winding tube increases, the weight and diameter of the winding tube increase, and the value of moment of inertia of the winding tube increases. For this reason, the tension applied to the sheet rolled up around the winding tube largely changes, and the tension applied to the sheet portion progressively fed in the printer largely changes. To reduce the stress on the sheet, when conveying the sheet while applying the tension, the medium conveyance mechanism turns on/off a roll-up motor at a predetermined frequency, thereby adding/releasing the tension to/from the sheet.

In the large-format printing apparatus described in Japanese Patent Laid-Open No. 2012-236305, however, the tension roller serving as a tension application unit is arranged between the print position and a roll-up mechanical unit that rolls up the sheet around a paper tube. In this printing apparatus, the roll-up mechanical unit and the tension application unit are different members. This makes the apparatus arrangement complex and bulky and also increases the manufacturing cost.

In the medium conveyance mechanism described in Japanese Patent Laid-Open No. 2011-11889, the tension is added/released at a predetermined frequency. As the starting point of ON/OFF control of the roll-up motor for this purpose, the detection result of a first detection unit configured to detect the tension difference in the sheet width direction and a second detection unit configured to detect a positional shift in the width direction or a count value at a predetermined time interval or for a predetermined scan count is employed. In the digital control method of turning on/off the motor, the sheet may slack depending on its weight, and roll-up may be unstable. For example, when ON/OFF-controlling the motor in each scan, the slack of the sheet may be amplified. There is also apprehension that the apparatus arrangement may be complicated by providing special detection units such as the first and second detection units.

The present invention provides a technique of performing a stable roll-up operation by a simple arrangement.

SUMMARY OF THE INVENTION

According to one aspect of the present invention, there is provided a roll-up apparatus for rolling up a continuous sheet into a roll shape, comprising: a tension generation unit configured to generate a changeable tension to the continuous sheet; and a control unit configured to control the tension generation unit based on a roll-up condition of the continuous sheet.

Further features of the present invention will become apparent from the following description of exemplary embodiments with reference to the attached drawings.

BRIEF DESCRIPTION OF THE DRAWINGS

FIG. 11 is a table of operation modes and rotation force settings; and

DESCRIPTION OF THE EMBODIMENTS

Figure 1:
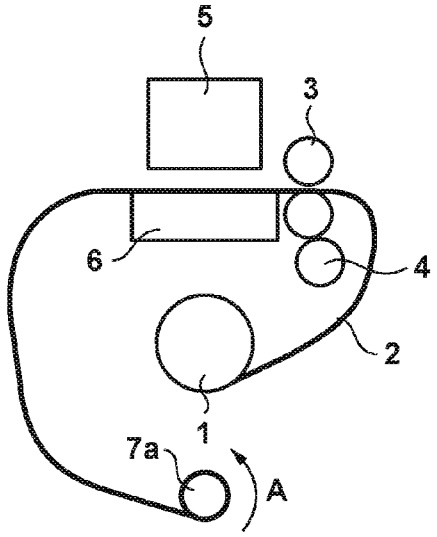
FIG. 1 is a schematic sectional view of an inkjet printer including a roll-up apparatus.

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

The same reference numerals denote the same elements throughout the drawings. The top and bottom, and left and right directions of the drawings will be used for an explanation in the specification as the top and bottom, and left and right directions of the apparatus according to each embodiment.

Note that in this specification, "print" not only indicates the formation of significant information such as characters and graphics but also broadly indicates the formation of images, figures, patterns, and the like on a print medium, or the processing of the medium, regardless of whether they are significant or insignificant and whether they are so visualized as to be visually perceivable by humans. Also, "continuous sheet" not only indicates a paper sheet serving as a print medium used in common printing apparatuses but also broadly indicates printable materials or materials capable of accepting ink, such as cloth, a plastic film, a metal plate, glass, ceramics, wood, and leather. "Continuous sheet" also indicates a continuous sheet long in the conveyance direction. "Ink" (also called a "liquid") should be extensively interpreted similar to the definition of "print" described above. That is, "ink" indicates a liquid which, when applied onto a print medium, can form images, figures, patterns, and the like, can process the print medium, and can process ink (for example, solidifying or insolubilizing a coloring agent contained in ink applied to the print medium).

<Arrangement of Main Body>

An inkjet printing apparatus according to an embodiment of the present invention will be described below. Each mechanical unit of the inkjet printing apparatus (to be sometimes abbreviated as a "printing apparatus" hereinafter) according to this embodiment can be classified into a feed unit, a conveyance unit, a printing unit, or the like in accordance with its function. The mechanical units will be described below. Note that in this embodiment, an inkjet printing apparatus will be described as an example. However, the present invention is also applicable to a roll-up apparatus that does not include a printing apparatus and rolls up a continuous sheet into a roll shape. The present invention is also widely applicable to printing apparatuses such as a printer, a multifunction peripheral, a copying machine, a facsimile apparatus, and various kinds of device manufacturing apparatuses. Print processing can be executed by any method such as an inkjet method, an electrophotographic method, a thermal transfer method, a dot impact method, or a liquid development method. The present invention is also applicable to a sheet processing apparatus that performs not only print processing but also various kinds of processing (printing, processing, coating, irradiation, reading, inspection, and the like) for a roll sheet.

Figure 2:
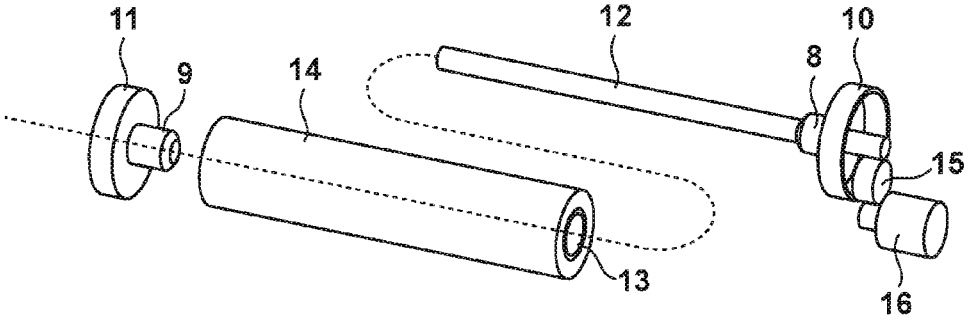
FIG. 2 is a perspective view showing the arrangement of the main body mount portion of a roll sheet.

FIG. 1 is a schematic sectional view of an inkjet printer that is an example of a printing apparatus including a feed mechanical unit 1 and a roll-up mechanical unit 7*a* according to the embodiment of the present invention. FIG. 2 is a perspective view showing the arrangement of the main body mount portion of a roll sheet 14 on the feed mechanical unit 1 and at least one (roll-up unit) of roll-up mechanical units 7*a* and 7*b* in FIG. 1. An operation of setting a print medium (roll sheet 14) in this embodiment will be described below.

<Feed Unit>

As the print medium, the roll sheet 14 that is a continuous sheet rolled up into a roll shape is used. As shown in FIG. 2, in the roll sheet 14, a spool shaft 12 is made to extend through a paper tube 13 at the roll center. A reference-side loading portion 8 of a reference-side roll sheet holder 10 arranged on the spool shaft 12 is pressed against the inner wall of the paper tube 13 by an elastic force in the radial direction. The roll sheet 14 is thus fixed and held on the reference-side loading portion 8. Note that the reference-side roll sheet holder 10 is fixed on the spool shaft 12 not to be rotatable.

Next, a non-reference-side roll sheet holder 11 is fitted on the spool shaft 12 from the reverse side of the reference-side roll sheet holder 10 and set on the paper tube 13 so as to sandwich the roll sheet 14. The non-reference-side roll sheet holder 11 includes a non-reference-side loading portion 9. The non-reference-side loading portion 9 is pressed against the inner wall of the paper tube 13 by an elastic force in the radial direction. The non-reference-side roll sheet holder 11 is thus fixed and held on the paper tube 13. When the two ends of the spool shaft 12 are pivotally supported on the feed mechanical unit 1 shown in FIG. 1, the roll sheet 14 is also pivotally supported. After the roll set, the rotation force of a roll motor 16 is transmitted to the spool shaft 12 via a driving gear 15 connected to the distal end of the spool shaft 12 to rotate the roll sheet 14, thereby controlling a changeable tension (to be described later). All the components for tension control correspond to a roll unit (tension generation unit) and a roll control unit (control unit) that controls switching between rotation driving and standby driving of the roll unit. Note that in this embodiment, the paper tube 13 that does not hold the roll sheet 14 is pivotally supported by the roll-up mechanical units 7*a* and 7*b*.

<Roll Sheet Conveyance>

Roll sheet conveyance from the feed mechanical unit 1 to the roll-up mechanical unit 7*a* will be described next. Out of the roll sheet 14 set on the feed mechanical unit 1, the leading end fed from the roll-shaped portion is guided to a conveyance roller pair 3 (conveyance rollers) via a feed path 2. A sheet detection sensor (not shown) is provided in the feed path 2. When the passage of the leading end of the roll sheet 14 is detected, the conveyance roller pair 3 starts being rotated in the sheet conveyance direction by a conveyance motor (motor) 4. Note that the roll sheet 14 in the feed path 2 can be conveyed manually by the user or by rotation driving of the feed mechanical unit 1, and the conveyance method is not particularly limited.

After the roll sheet 14 is nipped by the conveyance roller pair 3, the rotation amount of the conveyance roller pair 3 becomes the conveyance amount (feed amount) of the roll sheet 14. When the conveyance roller pair 3 further rotates, the roll sheet 14 is conveyed onto a platen 6. A carrier 5 that stores, for example, a printhead and a carriage portion and executes printing on the roll sheet 14 is arranged above the platen 6. The passage of the conveyed roll sheet 14 is detected by an end detection sensor (not shown) mounted on the carrier 5. It is thus confirmed that the roll sheet 14 has reached the platen. All the conveyance components for the roll sheet 14, including the conveyance roller pair 3 and the conveyance motor 4, correspond to a conveyance unit.

<Roll-Up Mechanical Unit 7>

To perform printing while rolling up the roll sheet 14, the conveyance roller pair 3 is further rotated in the sheet conveyance direction to move the leading end of the roll sheet 14 up to the vicinity of the roll-up mechanical unit 7*a*. In the initial state in which the roll sheet 14 does not reach the roll-up mechanical unit 7*a*, only the paper tube 13 shown in FIG. 2 is fitted on the spool shaft 12 and rotatably supported by the roll-up mechanical unit 7*a*. The leading end of the roll sheet 14 fed by the conveyance roller pair 3 is fixed on the paper tube 13 by a tape or the like, thereby performing roll set on the roll-up mechanical unit 7*a* (for example, see FIG. 7). Next, when the paper tube 13 of the roll-up mechanical unit 7*a* is rotated, the roll sheet 14 is wound around the paper tube 13 of the roll-up mechanical unit 7*a*. At this time, mainly by changing the rotation direction of the paper tube 13, the roll-up direction in which the paper tube 13 rolls up the roll sheet 14 can be changed. More specifically, two roll-up directions to be described below exist.

<Roll-Up Directions>

In the embodiment shown in FIG. 1, the paper tube 13 of the roll-up mechanical unit 7*a* rolls up the roll sheet 14 such that the surface of the roll sheet 14 printed by the carrier 5 faces outward. At this time, the paper tube 13 rotates counterclockwise (in the direction of an arrow A in FIG. 1), thereby performing the roll-up operation of the roll sheet 14. This roll-up operation will be referred to as an outer roll-up operation hereinafter. In an embodiment shown in FIG. 3, the paper tube 13 of the roll-up mechanical unit 7*b* rolls up the roll sheet 14 such that the surface of the roll sheet 14 printed by the carrier 5 faces inward. At this time, the paper tube 13 rotates clockwise (in the direction of an arrow B in FIG. 3), thereby performing the roll-up operation of the roll sheet 14. This roll-up operation will be referred to as an inner roll-up operation hereinafter.

<Printing Unit>

A printing unit for the roll sheet 14 conveyed to the platen 6 will be described next. Printing is performed by driving the carrier 5 in the widthwise direction of the roll sheet 14 perpendicular to the conveyance direction and causing the printhead mounted on the carrier 5 to discharge ink. Printing is advanced by alternately performing driving of the carrier 5 and conveyance of the roll sheet 14 by the conveyance roller pair 3.

<Roll-Up Conditions>

To perform printing while conveying the roll sheet 14 by the conveyance roller pair 3, the feed mechanical unit 1 applies an appropriate tension to the roll sheet 14 existing between the feed mechanical unit 1 and the conveyance roller pair 3. To do this, the rotation force of the roll motor 16 is controlled, thereby implementing predetermined image quality. The rotation force is controlled based on predetermined roll-up conditions such that the tension per unit length of the conveyance roller pair 3 becomes even. The roll-up conditions include the roll-up direction, sheet type information (sheet type) of the roll sheet 14, sheet width information (sheet width), and sheet diameter information (the diameter of the roll and the diameter of the continuous sheet rolled up by the roll unit) that changes at all times. Note that details of the control will be described later.

<Force Upon Roll-Up>

The relationship of the force at the time of the roll-up operation in the outer roll-up operation and the inner roll-up operation shown in FIGS. 1 and 3 will be described. In the feed mechanical unit 1, the roll sheet 14 is wound around the paper tube 13. Since the roll sheet 14 is stored in this state, the roll sheet 14 is shaped so as to wind around the paper tube 13. By this shaping, a force to bend the roll sheet 14 is generated. This is a phenomenon mainly called curling. In the roll sheet 14 on the platen 6, the curling force acts to push the printed surface up toward the carrier 5. As a component to cancel the curling, the roll sheet 14 is sucked by a negative pressure from an air pressure port (not shown) formed in the platen 6. As the paper tube 13 of the roll-up mechanical unit 7*a* rotates, the printed roll sheet 14 is sequentially rolled up by the paper tube 13.

The roll-up mechanical unit 7*a* for the outer roll-up operation shown in FIG. 1 is configured to roll up the roll sheet 14 in the same direction as the direction of curling generated by the feed mechanical unit 1, and can cancel the curling by a relatively small force. On the other hand, the roll-up mechanical unit 7*b* for the inner roll-up operation shown in FIG. 3 is configured to roll up the roll sheet 14 in a direction reverse to the direction of curling generated by the feed mechanical unit 1. At this time, since the curling generates a force to expand the roll sheet 14 in a direction in which the roll sheet 14 separates from the center of the paper tube 13, it is necessary to do roll-up while flattening the sheet shape by the curling. If the curling cannot completely be canceled, part of the roll sheet 14 separated from the center of the paper tube 13 may come into contact with a member near the roll-up, and the load by the sliding friction may increase. Hence, when rolling up the roll sheet 14 of the same material, the roll-up operation needs to be performed by a larger force in the inner roll-up operation as compared to the outer roll-up operation.

The force by the curling changes depending on a physical property value such as the type of the roll sheet 14. For example, the force by the curling is relatively small in plain paper or the like whose stiffness and thickness as the sheet type physical properties are small. On the other hand, in glossy paper or the like, the stiffness and thickness are large, and the force by the curling is large.

Figure 5:
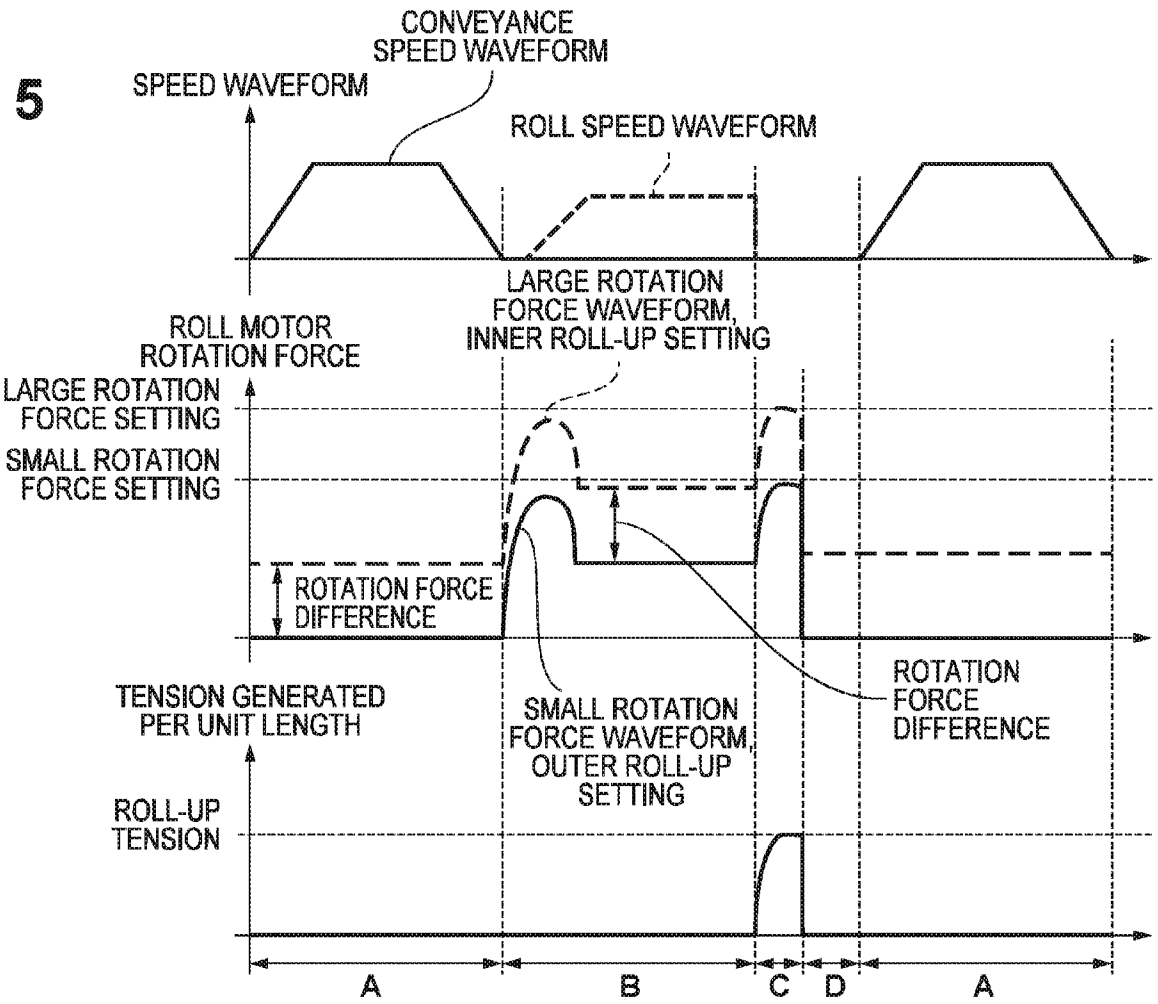
FIG. 5 is an explanatory view of a roll-up operation in asynchronous control according to the second embodiment.
Figure 6:
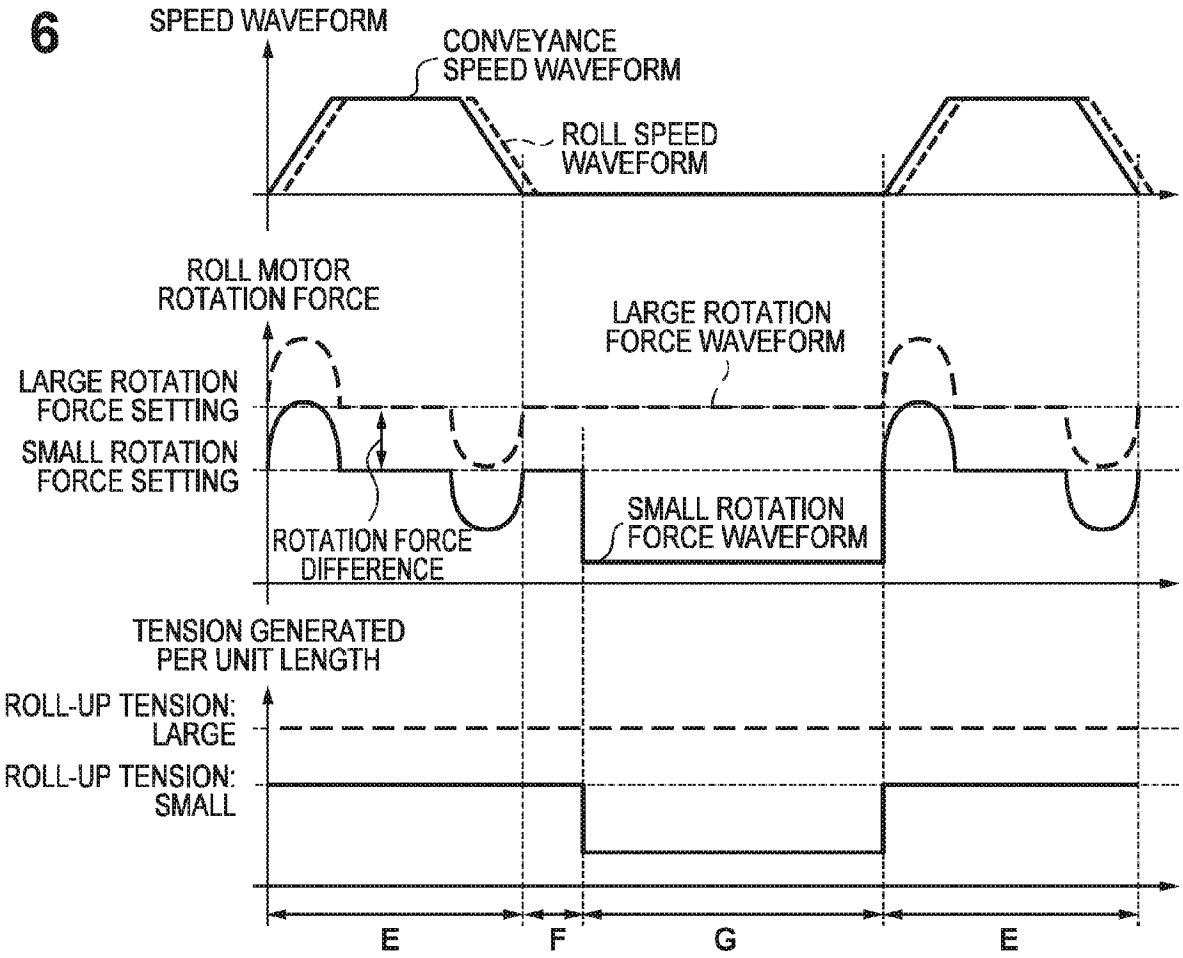
FIG. 6 is an explanatory view of a roll-up operation in synchronous control according to the third embodiment.

On the other hand, to improve image quality in printing with the roll-up operation, the roll-up operation needs to be performed by a minimum force necessary for the roll-up operation of the roll sheet 14. For this purpose, roll-up control is timely performed such that the tension per unit length of the conveyance roller pair 3 becomes even with respect to the sheet width or roll diameter of the roll sheet 14, and additionally, a minimum roll-up force is set. The minimum roll-up force means a minimum roll-up force necessary for the roll-up operation considering an increase/decrease in the force by curling depending on the sheet type or the force difference in the roll-up function by curling in the outer roll-up operation or inner roll-up operation. After the minimum roll-up force is set, the roll motor 16 is caused to generate a rotation force corresponding to the roll-up force. Concerning the roll-up force setting, FIGS. 4, 5, and 6 show the relationship between conveyance control and roll control in various kinds of operation modes.

First Embodiment

Figure 4:
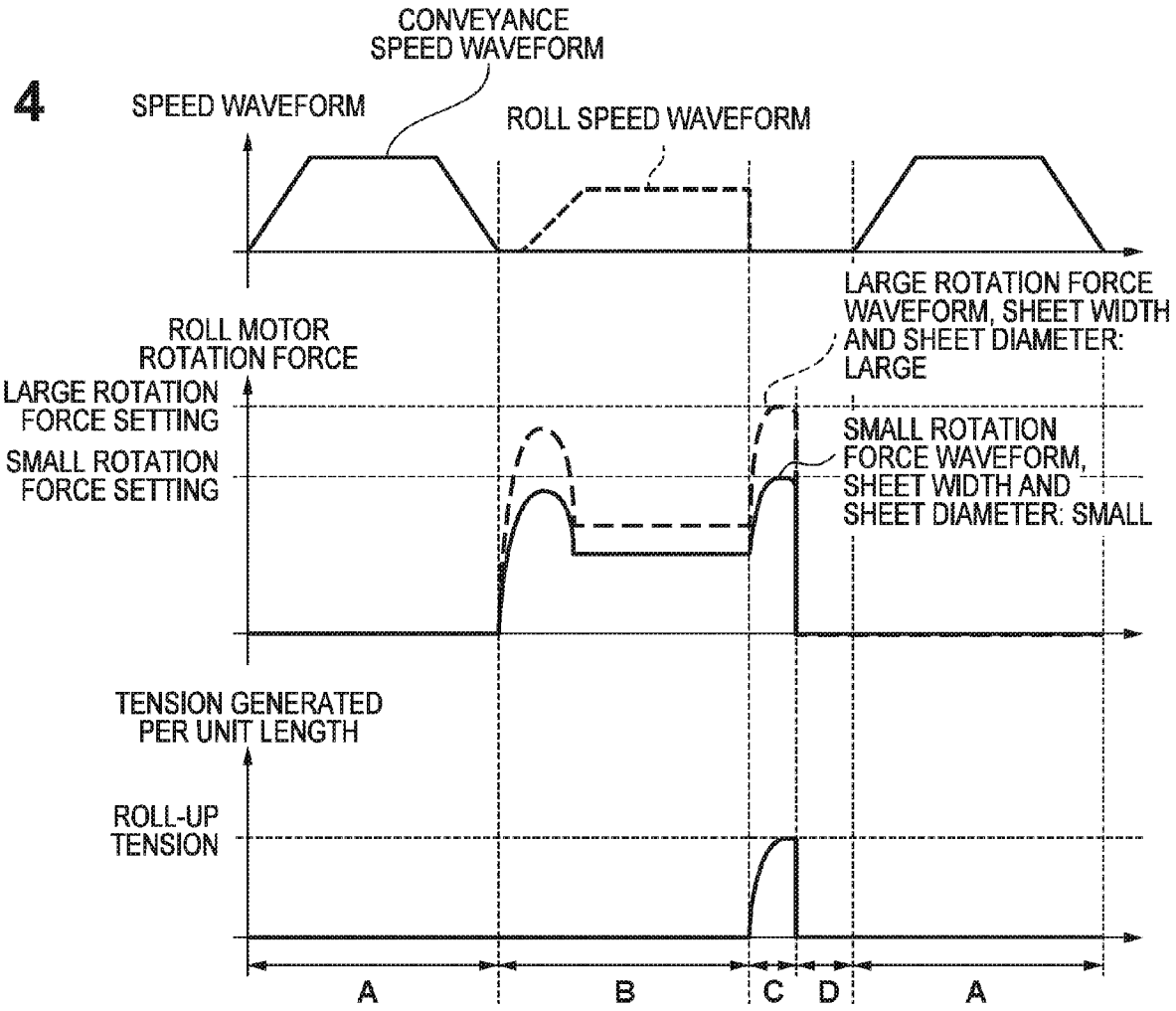
FIG. 4 is an explanatory view of a roll-up operation in asynchronous control according to the first embodiment.

FIG. 4 shows the relationship between conveyance control and roll control according to the first embodiment. In a case in which the sheet type of a roll sheet 14 is the same, and the width of the sheet and the diameter of the rolled-up sheet change, the relationship between conveyance control by a conveyance roller pair 3 and roll control by a roll-up mechanical unit 7*a* will be explained using the outer roll-up operation shown in FIG. 1 as an example. FIG. 4 shows waveforms on the upper, middle, and lower rows. For the upper waveform, the ordinate represents the speed value, and the abscissa represents time. The speed waveform of the conveyance roller pair 3 and that of a paper tube 13 (roll unit) of the roll-up mechanical unit 7*a* are illustrated. A conveyance speed change in conveyance control of the conveyance roller pair 3 is indicated by a solid line as a conveyance speed waveform. A roll-up speed change in roll control of the paper tube 13 is indicated by a dotted line as a roll speed waveform.

The middle waveform in FIG. 4 indicates a change in the rotation force of a roll motor (roll driving unit) 16 in roll control according to the time series of the speed waveform on the upper row. For the middle waveform, the ordinate represents the rotation force (driving force) generated by the roll motor 16, and the generated rotation force becomes large upward along the ordinate. In addition, as the roll-up directions of the roll sheet 14, the middle waveform indicates a small rotation force waveform by a solid line (small rotation force setting) in a case in which the sheet width information is small, and the sheet diameter information is small, and a large rotation force waveform by a dotted line (large rotation force setting) in a case in which the sheet width information is large, and the sheet diameter information is large. In the large rotation force setting, the rotation force of the roll motor is set to be larger than that in the small rotation force setting.

The lower waveform in FIG. 4 indicates a roll-up tension generated on the conveyance roller pair 3 starting from the roll-up mechanical unit 7*a* with respect to the tension per unit length of the conveyance roller pair 3. The generated tension becomes large upward along the ordinate.

As for the operation conditions in FIG. 4, as the basic concept, during the stop of driving of the conveyance roller pair 3, roll-up driving by the roll-up mechanical unit 7*a* is performed with a delay to generate the roll-up tension for the conveyance roller pair 3. A region where the conveyance roller pair 3 is driven to convey the roll sheet 14 for a predetermined time and feed it to the roll-up mechanical unit 7*a* under the conveyance control is indicated by a region A in FIG. 4. In the region A, the roll motor rotation force setting of the roll-up mechanical unit 7*a* indicates 0, and the roll sheet 14 in the roll-up mechanical unit 7*a* is at rest while being in balance with a mechanical load (the roll-up mechanical unit 7*a* is not rotated by the conveyed roll sheet 14). At this time, a roll slack occurs between the conveyance roller pair 3 and the roll-up mechanical unit 7*a* as much as the conveyance amount of the fed roll sheet 14.

During the rest of the conveyance roller pair 3 for the predetermined time after the start of conveyance, the roll sheet 14 is rolled up by the roll-up operation of the roll-up mechanical unit 7*a*. The regions are indicated by regions B and C in FIG. 4. In the region B, immediately after the roll-up mechanical unit 7*a* starts the roll-up operation, a roll slack occurs. Hence, the roll-up mechanical unit 7*a* performs the roll-up operation at a predetermined target speed until the slack is eliminated. In this state, when accelerating the roll sheet 14 (acceleration driving region), the roll rotation force is generated in consideration of the acceleration torque (acceleration inertia) of a roll inertia (to be described later). After the roll sheet 14 changes to constant-speed driving (constant-speed driving region), a rotation force balanced with the mechanical load is generated.

When the roll-up operation is completed up to a state in which the roll slack is eliminated, the roll sheet 14 stops moving (post-stop region). The state after shifting to this condition is the region C shown in FIG. 4. In the region C, since the speed cannot reach the target speed in the roll-up mechanical unit 7*a*, the calculation result of FB control increases. The upper limit to the rotation force (the upper limit of the driving force) at this time is set to the roll-up rotation force setting value (driving force) in roll motor rotation force setting (roll control unit) at the time of roll-up driving, thereby generating an arbitrary roll-up tension (see the lower waveform). In the region C, roll-up is performed by the rotation force of the upper limit. When the roll sheet stops moving (changes to a lock state), and a predetermined time elapses, the operation in the current roll-up operation is regarded to have ended, and the operation transits to a region D.

The region D corresponds to a period to prepare for the next driving of conveyance control. Here, the operation transits to the same rotation force setting as in the region A. The regions B and C correspond to roll-up driving, and the regions A and D correspond to standby driving. The series of iterative operations from the region A to the region D in this embodiment represents a motion in an asynchronous control mode (asynchronous mode). A minimum roll-up tension is applied only in the region C. When the roll-up tension is generated only in the region C, sheet damage can be minimized. In addition, since the sheet stress at the time of roll-up is released in the regions A and D, malfunction in the roll-up operation can be minimized. The asynchronous control mode is selected by the roll control unit.

The middle waveform in FIG. 4 shows two waveforms, that is, a small rotation force waveform (the solid line in FIG. 4) and a large rotation force waveform (the dotted line in FIG. 4). When the sheet width of the roll sheet 14 is large, the region nipped by the conveyance roller pair 3 increases, and the tension per unit length lowers in the same rotation force setting as that for a small sheet width. As the sheet width increases, the roll rotation force is made large. This can make the tension per unit length of the conveyance roller pair 3 even. Note that as for the sheet width, for example, a sheet width recorded in a ROM 24 (to be described later) in advance may be used, or the sheet width may be detected using a line sensor formed by arranging optical sensors (not shown) in the widthwise direction of the roll sheet 14.

If the diameter of the roll sheet 14 rolled up by the paper tube 13 is large, the rotation force of the roll motor 16 is converted into a tension generated in the roll circumferential direction. Since the tension is inversely proportional to the diameter, the tension per unit length lowers in the same rotation force setting as that for a small diameter. Note that the diameter of the roll sheet 14 may be obtained from, for example, the thickness of the roll sheet 14 recorded in the ROM 24 and the number of rotations of the paper tube 13 to roll up the roll sheet 14. The diameter of the roll sheet 14 may be detected using a line sensor formed by arranging optical sensors (not shown) in the roll radial direction. Note that as the roll-up diameter of the roll sheet 14, not the diameter but the radius may be employed.

As the diameter increases, the roll rotation force is made large. This can make the tension per unit length of the conveyance roller pair 3 even. Considering these conditions, the roll motor rotation force in a case in which the sheet width information is small, and the sheet diameter information is small is set to be smaller than in a case in which the sheet width information is large, and the sheet diameter information is large. The middle waveform in FIG. 4 shows this state as the small rotation force waveform of the solid line and the large rotation force waveform of the dotted line. The upper limit of the actually generated rotation force is used as the small rotation force setting or large rotation force setting. Although the rotation force settings are different, the actually generated tensions per unit length equal. This is indicated by the roll-up tension of the lower waveform shown in FIG. 4.

Second Embodiment

FIG. 5 shows the relationship between conveyance control and roll control according to the second embodiment. The relationship between conveyance control and roll control will be explained using not the outer roll-up operation shown in FIG. 1 but the inner roll-up operation shown in FIG. 3 as an example, assuming that the sheet type, sheet width, and diameter of a roll sheet 14 are the same as in the outer roll-up operation. FIG. 5 shows a speed waveform on the upper row, the waveform of a roll motor rotation force on the middle row, and a tension generated per unit length on the lower row, like FIG. 4. For the upper waveform, the ordinate represents the speed value, and the abscissa represents time. The speed waveform of a conveyance roller pair 3 and that of a paper tube 13 (roll unit) of a roll-up mechanical unit 7*b* are illustrated. A conveyance speed change in conveyance control of the conveyance roller pair 3 is indicated by a solid line as a conveyance speed waveform. A roll-up speed change in roll control of the paper tube 13 is indicated by a dotted line as a roll speed waveform.

The middle waveform in FIG. 5 indicates a change in the rotation force of a roll motor (roll driving unit) 16 in roll control according to the time series of the speed waveform on the upper row. For the sake of comparison, a waveform in the outer roll-up operation shown in FIG. 1 is indicated by a solid line as a small rotation force waveform, and a waveform in the inner roll-up operation shown in FIG. 3 is indicated by a dotted line as a large rotation force waveform. The roll motor rotation force in the large rotation force waveform is set to be larger than in the small rotation force waveform by a rotation force difference (to be described later).

The lower waveform in FIG. 5 indicates a roll-up tension generated on the conveyance roller pair 3 starting from the roll-up mechanical unit 7*b* with respect to the tension per unit length of the conveyance roller pair 3. The generated tension becomes large upward along the ordinate.

The basic concept of the operation conditions in FIG. 5 complies with the asynchronous control mode described with reference to FIG. 4. FIG. 5 is different from FIG. 4 in the manner the rotation force setting in the middle waveform is given. As described above, the outer roll-up operation shown in FIG. 1 and the inner roll-up operation shown in FIG. 3 are different in the force of curling generated on the roll sheet 14. In this embodiment, the conditions of the sheet width and diameter are the same as those of the roll sheet 14 of the embodiment shown in FIG. 4. However, different rotation forces are set for the outer roll-up operation and the inner roll-up operation.

For example, if the same rotation force as in the outer roll-up operation is set for the inner roll-up operation, the rotation force is consumed when canceling curling, and the tension per unit time lowers in the inner roll-up operation as compared to the outer roll-up operation. In some cases, the force to cancel curling may be short, and a roll-up failure may occur. Hence, in regions B and C corresponding to roll-up driving, a rotation force (rotation force difference) corresponding to cancel of curling is added, and this state is indicated by the arrow of the rotation force difference between the dotted line and the solid line.

In regions A and D corresponding to standby driving as well, the rotation force setting for the inner roll-up operation is not 0, and a rotation force balanced with the force of curling is generated. This state is represented by the rotation force difference. Hence, in the inner roll-up operation, the rotation force difference is added in general to make the roll motor rotation force large. The tension per unit time of the conveyance roller pair 3 can thus be made even, and the rotation of the roll sheet 14 in the roll-up operation can be stabilized so as to implement both the improvement of image quality and stabilization of the roll-up operation. This magnitude relationship of rotation force setting values is set in the roll control unit individually for roll-up driving and standby driving. A final setting value is calculated from the setting value in consideration of the sheet width and the sheet diameter for each roll-up condition.

Note that in the embodiment, the setting value of the roll motor rotation force is 0 in the standby operation regions A and D of the outer roll-up operation shown in FIG. 4. However, even in the outer roll-up operation, relatively large curling may occur, and the roll may loosen depending on the sheet type. In this case, the roll motor rotation force may be set to a nonzero value in the standby operation regions A and D of the outer roll-up operation to cope with this problem. That is, the roll-up rotation force in the roll control unit at the time of standby driving is adjusted based on the sheet type to cope with the problem, and the setting value need not always be fixed to 0. However, the value may be set to 0 from the viewpoint of minimizing power consumption. Note that, for example, when the roll sheet 14 that is relatively thin and has a small curling force is used, the rotation force may be set to 0, as in FIG. 4. Additionally, when the roll-up tension in standby driving is set to 0, a weak tension may be given depending on the sheet properties. In this case, the roll-up rotation force in standby driving may be set to a slightly large nonzero value.

In addition, when stabilizing the rotation of the roll sheet 14 in the standby operation regions A and D, a rotation force (the value of a position control result) may further be added with respect to the roll motor rotation force in standby driving set by the roll control unit as a reference (reference value). More specifically, the position of the roll sheet 14 transited to standby driving is set as the target position (stop target position). If a deviation from the target position occurs, hold control may be performed to make the roll control unit apply a roll rotation force (the value of the position control result) in a direction to correct the deviation. The weight of the roll sheet 14 changes depending on a print condition or an environmental change. Hence, overall stability can be increased by canceling the variation conditions by the hold control.

In the asynchronous control mode shown in FIGS. 4 and 5, after the conveyance roller pair 3 stops driving, roll-up driving by the roll-up mechanical unit 7*a* or 7*b* is performed. However, if the amount of one conveyance by the conveyance roller pair 3 is very large, a large roll slack may occur to cause a roll-up failure before the stop of driving. To cope with this, the roll slack may be monitored from a state in which conveyance driving of the conveyance roller pair 3 has started, and when a slack of a predetermined amount or more occurs, roll-up driving may be started even before the stop of driving. Even in this case, the roll sheet is rolled up under the condition that a roll slack has occurred. Hence, even in this case, the roll-up tension is actually generated after the roll-up operation is completed, and transition to the region C occurs.

In addition, as one method of stabilizing the roll slack, the driving target speed of roll-up driving may be adjusted in accordance with the roll slack amount. If the slack is large, the roll sheet 14 is rolled up at a high speed. If the slack is small, the roll sheet 14 is rolled up at a low speed. This makes it possible to implement a stable roll-up operation while suppressing an excessive tension when transiting to the region C.

Third Embodiment

The relationship between conveyance control and roll control according to the third embodiment will be described with reference to FIG. 6. A synchronous control mode (synchronous mode) that needs to perform roll-up driving while always giving a tension to a roll sheet 14, unlike the asynchronous control mode shown in FIGS. 4 and 5, will be explained. This is a description of roll-up driving when coping with a case in which printing needs to be performed on, for example, a vinyl sheet while stretching the sheet.

The relationship between conveyance control and roll control will be explained with reference to FIG. 6 concerning a pattern in which the sheet width of the roll sheet 14 and the diameter of the rolled up roll sheet 14 are the same as in the above-described embodiments, but the sheet type of the roll sheet 14 is different, and therefore, the tension setting is different. The description will be made without particular designation of the inner roll-up operation and the outer roll-up operation, assuming a case in which a magnitude relationship is generated in the tension setting that enables stretching because of the difference in the sheet type.

FIG. 6 shows a speed waveform on the upper row, the waveform of a roll motor rotation force on the middle row, and a tension generated per unit length on the lower row, like FIG. 4. For the upper waveform in FIG. 6, the ordinate represents the speed value, and the abscissa represents time. A conveyance speed change in a conveyance roller pair 3 is indicated by a solid line as a conveyance speed waveform. A roll-up speed change in roll-up mechanical unit 7*a* or 7*b* is indicated by a dotted line as a roll speed waveform.

The middle waveform in FIG. 6 indicates a change in the rotation force of a roll motor 16 in roll control according to the time series of the speed waveform on the upper row. A case in which the tension setting is relatively low in the synchronous control mode because of the difference in the sheet type is indicated by a solid line as a small rotation force waveform, and a case in which the tension setting is relatively high is indicated by a dotted line as a large rotation force waveform. The ordinate represents a rotation force generated by the roll motor, and the generated rotation force becomes large upward along the ordinate.

The lower waveform in FIG. 6 indicates a roll-up tension generated on the conveyance roller pair 3 starting from the roll-up mechanical unit 7*a* or 7*b* with respect to the tension per unit length of the conveyance roller pair 3. The generated tension becomes large upward along the ordinate.

As for the operation conditions in FIG. 6, as the basic concept, an operation aiming at a motion for generating a desired roll-up tension is performed irrespective of whether the conveyance roller pair 3 is driven or stands by. A region where the conveyance roller pair 3 is driven to feed the roll sheet 14 to the roll-up mechanical unit 7*a* or 7*b* is indicated by a region E in FIG. 6. In the region E, the rotation force is increased/decreased in accordance with the acceleration driving region, constant-speed driving region, and deceleration driving region of the roll sheet 14 in the conveyance roller pair 3 with respect to the roll-up rotation force in roll-up driving as a reference.

When a constant tension is applied, a rotation force balanced with a mechanical load and the acceleration torque (acceleration inertia) of a roll inertia is necessary at the time of acceleration in the acceleration driving region of the roll sheet 14. At a constant speed in the constant-speed driving region of the roll sheet 14, a rotation force balanced with a mechanical load is necessary. At the time of deceleration in the deceleration driving region, a rotation force balanced with a mechanical load and the deceleration torque of the roll inertia is necessary. Considering these variation factors, a rotation force (driving force) corresponding to a tension to be generated needs to be added to the reference rotation force. For this reason, a value obtained by adding the balance to mechanical load to the roll-up rotation force in roll-up driving is calculated as the central value of the small rotation force waveform or large rotation force waveform. At the time of acceleration, a value obtained by adding an acceleration inertia to the value is set as a driving force. At the time of deceleration, a value obtained by subtracting a deceleration inertia from the value is set as a driving force.

The difference between the small rotation force waveform and the large rotation force waveform is the rotation force corresponding to the difference of a target tension to be generated, which is indicated as a rotation force difference by an arrow in FIG. 6. That is, in the region E, the roll control unit performs FB control while setting the target value of the speed of the roll unit as a value equal to or more than the speed of the conveyance roller pair 3, and causes the roll unit to generate a desired tension by setting the upper limit of the output value as a rotation force setting value.

After the driving region of the conveyance roller pair 3 ends in the region E, the operation transits to a region F. The region F represents a motion that, in a case in which a roll slack that has occurred during driving of the conveyance roller pair 3 is not completely eliminated, intends to complete the roll-up operation up to a state in which the roll slack is eliminated.

When the roll driving unit is driven for a predetermined time, and a predetermined time elapses after the roll sheet 14 stops moving, the operation in the current roll-up operation is regarded to have ended, and the operation transits to a region G. The region G corresponds to a period to prepare for the next driving of conveyance control. In the small rotation force setting, a motion is made assuming that a tension weaker than in driving is given at the time of standby of the conveyance roller pair 3. On the other hand, in the large rotation force setting, a motion is made assuming that an even tension is given irrespective of whether the conveyance roller pair 3 is driven or stands by. The operation may be done by arbitrarily selecting an appropriate setting based on the relationship of the properties of the sheet to be rolled up. Even in the small rotation force setting, for a sheet that needs an even tension in both the driving and standby states, a rotation force of the same value as in the region F may be applied even after the transition of the region G. After that, the state transits to the region E again, and the conveyance roller pair 3 is driven.

The lower waveform in FIG. 6 indicates a tension in the small rotation force setting as a small roll-up tension, and a tension in the large rotation force setting as a large roll-up tension. The difference between them is the tension difference to be applied. The small roll-up tension in the region G exhibits a value smaller than in the regions E and F. This represents a decrease in sheet damage and a decrease in power consumption.

In this embodiment, the regions E and F correspond to roll-up driving, and the region G corresponds to standby driving. The roll control unit sets the driving force of roll-up driving. In standby driving, the roll control unit sets the driving force individually depending on the standby driving conditions. For both the driving forces, a final setting value is calculated in consideration of the sheet width and the sheet diameter. The series of iterative operations from the region E to the region G represents a motion in a synchronous control mode. A minimum necessary roll-up tension is always applied. The synchronous control mode is selected by the roll control unit.

Fourth Embodiment

Figure 3:
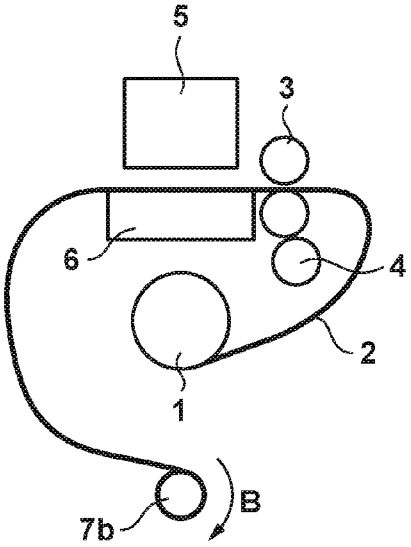
FIG. 3 is a schematic sectional view of an inkjet printer including a roll-up apparatus.
Figure 7:
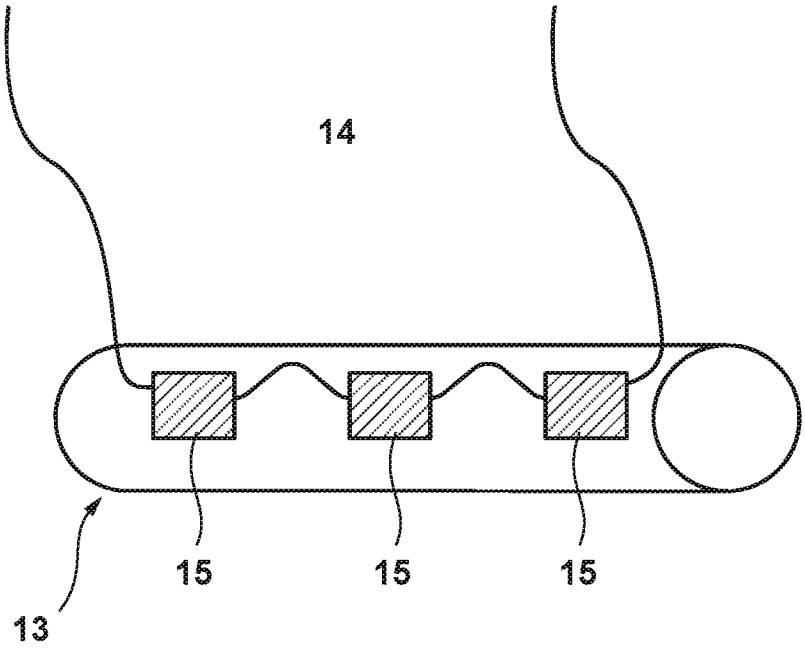
FIG. 7 is an explanatory view of an example of roll sheet mount on a paper tube.

FIG. 7 shows a phenomenon that occurs in a case in which the sheet type physical properties of a roll sheet 14 represent a high stiffness when fixing the roll sheet 14 to a paper tube 13 in, for example, the inner roll-up operation shown in FIG. 3. A hatched portion 15 in FIG. 7 represents a fixing member such as a tape that fixes the roll sheet 14. In a case in which the roll sheet 14 has a high stiffness, if taping is done under this condition, a reaction force generated by curling is strong, and the leading end of the sheet becomes wavy between a region with a tape and a region without a tape, as shown in FIG. 7. If the roll-up operation is performed in this state, only regions that are not taped rise and rub against the periphery during one rotation of the paper tube 13, and the other portions do not rub. This may cause a large load variation. Such a load variation changes in any way depending on the user's roll sheet placement condition, and the condition is not determined in advance. To begin with, the roll sheet 14 to be placed has various properties in itself, and there is no guarantee to mount a sheet whose properties are known in advance. Since the roll-up operation is performed only by a rotation force set to obtain a predetermined roll-up tension under this condition, the roll-up operation may eventually be impossible.

Figure 8:
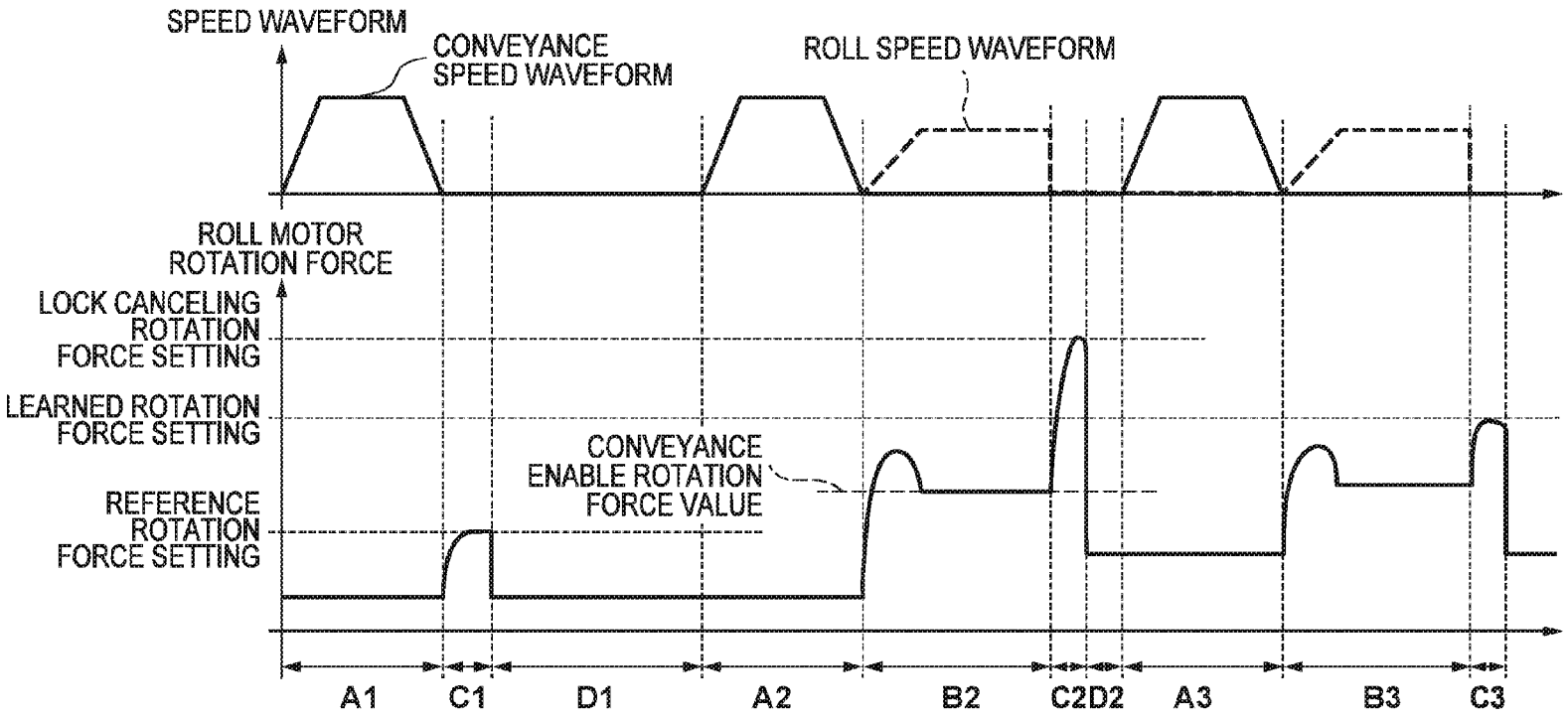
FIG. 8 is an explanatory view of a roll-up operation in a lock state according to the fourth embodiment.

In the fourth embodiment shown in FIG. 8, a rotation force setting to absorb the physical phenomenon will be described. The relationship between conveyance control and roll control will be explained with reference to FIG. 8 using roll-up in the inner roll-up operation shown in FIG. 3 as an example. However, this embodiment is not limited to the inner roll-up operation. FIG. 8 shows a speed waveform on the upper row, and the waveform of a roll motor rotation force on the lower row. For the speed waveform on the upper row, the ordinate represents the speed value, and the abscissa represents time. A conveyance speed change in a conveyance roller pair 3 is indicated by a solid line as a conveyance speed waveform. A roll-up speed change in a roll control unit is indicated by a dotted line as a roll speed waveform.

The waveform of the roll motor rotation force of the lower waveform indicates a change in the rotation force of a roll motor 16 in the roll control unit according to the time series of the speed waveform on the upper row. The ordinate represents the rotation force generated by the roll motor, and the generated rotation force becomes large upward along the ordinate. The basic concept of the operation conditions in FIG. 8 complies with the asynchronous control mode described with reference to FIGS. 4 and 5, and a description thereof will be omitted.

FIG. 8 shows a conveyance state corresponding to three conveyance cycles. Conveyance regions by the conveyance roller pair 3 are represented by A1, A2, and A3. The outline of this embodiment will be described. A roll-up failure occurs in the conveyance timing of the regions A1 to D1. In the conveyance timing of the regions A2 to D2, rotation force adjustment is performed to cope with the roll-up failure in the regions A1 to D1. First, a state that enables the roll-up operation is created. In the conveyance timing of the regions A3 to C3, a rotation force learned according to the operation conditions in the regions A2 to D2 is set, thereby stabilizing subsequent driving. Such an example of rotation force adjustment control will be described.

More specifically, in the conveyance timing of the regions A1 to D1, roll-up is performed by the rotation force setting described concerning the inner roll-up operation shown in FIG. 5 according to the second embodiment. As for the rotation force setting value at this time, a rotation force is set considering sheet width information and sheet diameter information (roll-up conditions) in addition to a reference roll-up rotation force setting value (reference driving force). The value expressed as reference rotation force setting in FIG. 8 is the upper limit. At this time, if the load variation is large, as described with reference to FIG. 7, it may be impossible to perform the roll-up operation using the rotation force decided in advance. For example, if the roll sheet 14 stops moving, the roll control unit erroneously recognizes that the roll sheet 14 is completely rolled up (region C1), transits to standby driving (region D1), and waits until the start of next conveyance control (region A2).

In the conveyance timing of the regions A2 to D2, the state in which the roll sheet 14 has stopped in the previous region A1 is detected, rotation force adjustment (conveyance enable rotation force value, the region B2) is performed to cope with the state, and the roll-up operation is performed. The state in which the roll sheet 14 stops moving is defined here as a lock state (lock). The number of times of lock state occurrence is counted by a lock count detection unit (detection unit). The lock count detection unit increments the lock count if the lock state continuously occurs, and initializes the lock count to 0 when the lock state is canceled, and the roll-up operation is normally performed. In a rotation force setting to cancel lock, an adjustment unit calculates the adjustment value of the driving force in accordance with the lock count.

If a large rotation force is employed to cancel lock, recovery from the lock state can be attained easily. On the other hand, sheet damage may increase. From the viewpoint of canceling the lock state while minimizing sheet damage, the rotation force to cancel lock may gradually be increased based on the lock count. To calculate the lock canceling rotation force setting value (canceling driving force) as the upper limit of the rotation force for lock canceling shown in the region C2, several methods can be considered. As one of the methods, the adjustment unit multiplies the reference rotation force setting value by a coefficient to decide the rotation force to be added.

The reference rotation force setting value is a value obtained by considering the sheet width and diameter (roll-up conditions) of the roll sheet 14 in addition to the reference roll-up rotation force setting value (reference driving force). Hence, as the lock canceling rotation force setting value (canceling driving force) obtained by multiplying the value by a coefficient, the adjustment unit obtains a value considering the sheet width and diameter. When multiplying a coefficient, a value based on the coefficient value (adjustment value) corresponds to the lock canceling rotation force setting value. As another method, the adjustment unit sets a rotation force for lock canceling to be added in correspondence with a certain sheet width and diameter, adds the value to the reference roll-up rotation force setting value, and obtains the final rotation force setting value considering the sheet width and diameter. This rotation force setting value corresponds to the lock canceling rotation force setting value.

At any rate, if the lock count is a predetermined count or less, the adjustment unit selects the lock canceling rotation force setting value in accordance with the lock count, and obtains the lock canceling rotation force setting value considering the sheet width and diameter. Note that the predetermined count is a count capable of canceling the lock state by changing the roll-up rotation force and, for example, several times. When the lock canceling rotation force setting value is set individually for each sheet type information, it is probably possible to cancel the lock state by a minimum torque according to the sheet properties and continue the roll-up operation. Note that if the lock count is larger than the predetermined count, the adjustment unit may determine that an error state is set, and interrupts setting of the driving force. In the region D2, the apparatus prepares for the next driving of conveyance control based on the reference rotation force adjusted in the regions B2 to C3.

In the conveyance timing of the regions A3 to C3, driving is performed by adjusting the reference rotation force based on the rotation force information by the lock cancel state in the regions A2 to D2. The lock canceling operation in the regions A2 to D2 aims at canceling lock and continuing the roll-up operation. Hence, the roll-up operation is not always performed by an optimum rotation force. Additionally, in the region A2, the rotation force setting is generated for the first time after the stop. For this reason, when the region A2 is repeated, the roll-up operation and the lock state are repeated. Hence, stability of the roll-up operation is not always ensured. For this reason, in the lock canceling operation in the region A2, the rotation force that actually enables the roll-up operation is learned. Next, in the regions B3 and C3, the upper limit (updated driving force) of the learned roll-up rotation force adjustment value from the next time is calculated based on the value, thereby performing rotation force setting according to the load variation at the time of roll-up.

As described above, when the coefficient for lock canceling is provided for each sheet type, a minimum rotation force according to the load variation of the roll sheet 14 can be generated, and minimization of medium damage and a stable roll-up operation can be implemented. Here, the lock canceling coefficient is provided for each sheet type. However, the coefficient can be disabled by setting it to 0 and can freely be set in accordance with the type of the sheet to be conveyed. In the description here, the value is handled as a coefficient. However, it is not limited to a coefficient, and a fixed value or a value calculated from a table of sheet widths and diameters may be used.

<Control Arrangement>

Figure 9:
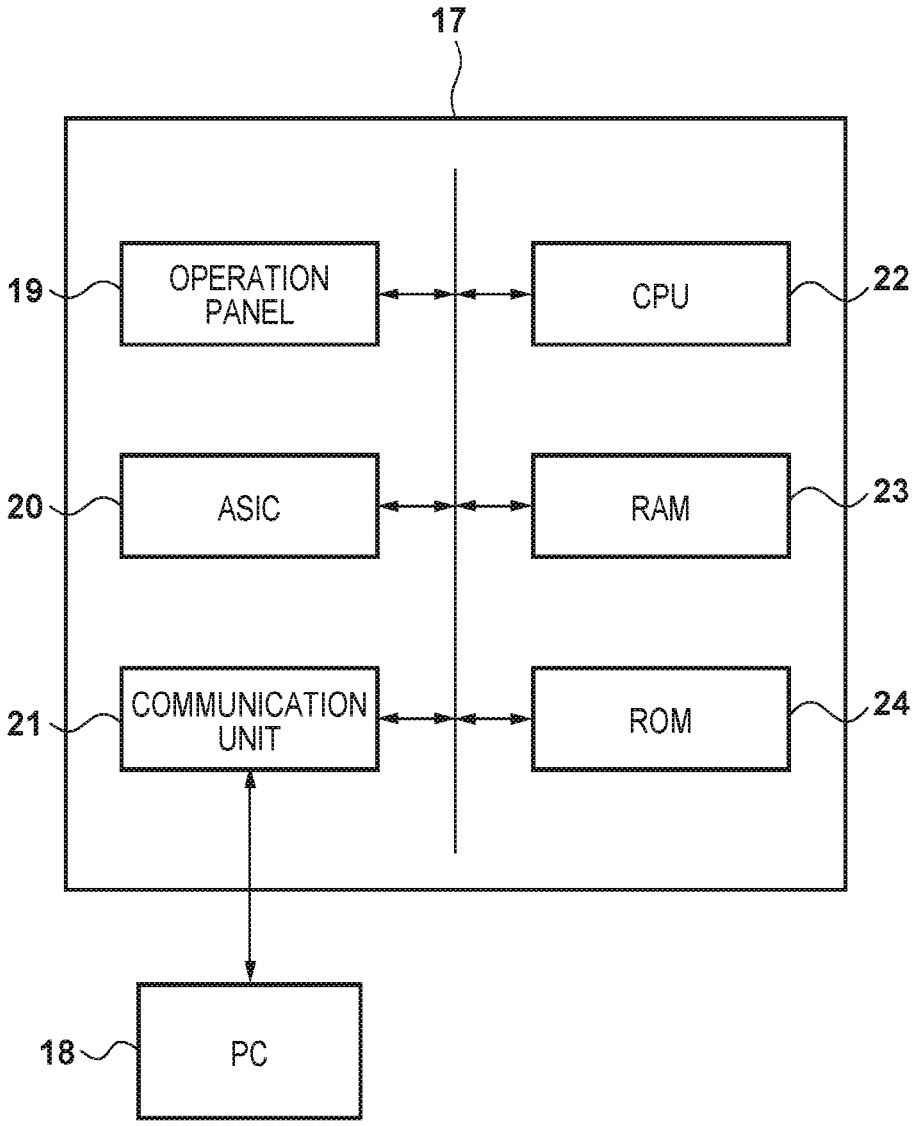
FIG. 9 is a block diagram of a control unit.
Figure 10:
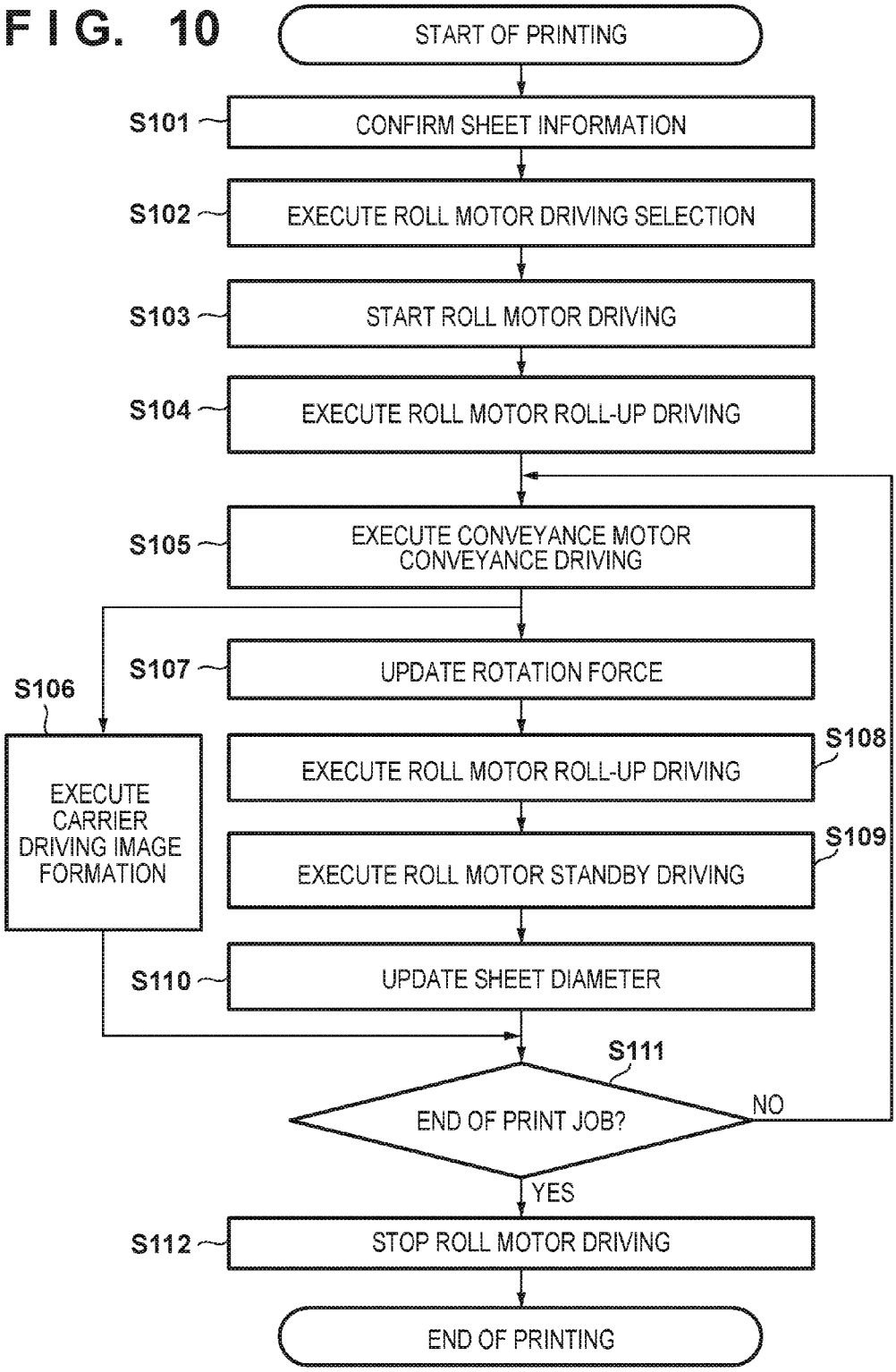
FIG. 10 is a flowchart of roll-up driving.

The synchronous control mode, the asynchronous control mode, the lock canceling control method, and the rotation force setting values at the time of roll-up driving in each mode according to the embodiments shown in FIGS. 4, 5, 6, and 8 have been described. Selectively using the rotation force setting value in roll-up driving and the standby rotation force setting value (standby driving force) in standby driving in accordance with the roll-up conditions or the rotation direction designation for the inner roll-up operation or outer roll-up operation has also been described. In the present invention, using the rotation force setting value as reference, a final rotation force (driving force) is calculated based on the sheet width and the sheet diameter and set as the driving force to the roll motor. In association with implementation of these concepts by an inkjet printer, FIG. 9 is a block diagram showing an example of the hardware arrangement of the inkjet printer according to the embodiment. FIG. 10 shows a driving control procedure so as to explain an example of driving control performed by a CPU 22 shown in FIG. 9.

In the hardware arrangement shown in FIG. 9, a control unit 17 that performs image processing and various kinds of actuator control is provided. The control unit 17 includes the CPU 22. The control unit 17 includes a roll control unit, control of a conveyance unit, a lock count detection unit, and an adjustment unit. The CPU 22 is an arithmetic processing device which performs various kinds of control arithmetic processing while loading programs stored in a ROM 24 to a RAM 23. Various kinds of rotation force settings according to sheet type information are held in the ROM 24 or the like in advance, loaded to the RAM 23 at the time of activation, and used in various kinds of control. An operation panel 19 is used to do various settings of the printer, and in this embodiment, used by the user to set sheet type information in a feed operation or the like. A rotation force for each sheet type may be set by the operation panel 19. An operation of further adjusting the rotation force saved in the ROM 24 is also possible. An ASIC 20 is an arithmetic processing unit formed by an integrated circuit configured to perform image processing or actuator operation, which executes arithmetic processing upon receiving an instruction from the CPU 22. A sheet conveyance control arithmetic block exists in the CPU 22. In this block, a conveyance motor driving control arithmetic block and a roll motor control arithmetic block exist. Driving timing control of motors and driving operations are executed in accordance with a print sequence. A communication unit 21 is used to issue a print instruction including image data from a PC 18. The printer side starts a print operation at the timing of receiving the image data from the communication unit 21.

<Driving Control Procedure>

FIG. 10 shows a driving control procedure of actually operating the printer including the roll-up apparatus shown in FIGS. 1 and 3 when a print instruction is issued via the communication unit 21. FIG. 10 shows driving of the conveyance motor 4 serving as the driving source of the conveyance roller pair 3 shown in FIGS. 1 and 3 and driving of the roll motor 16 as the roll-up mechanical units 7*a* and 7*b*. As the operation condition, the asynchronous control mode is assumed. In this procedure, the roll sheet 14 is rolled up after completion of driving of the conveyance motor 4. Although driving of the feed mechanical unit 1 is not illustrated, basically, tension control is performed to obtain a predetermined tension in accordance with the conveyance motor 4.

In FIG. 10, printing starts upon receiving a print instruction. First, to confirm the state to a sheet to be rolled up, sheet information is confirmed in step S101. In the sheet information confirmation of step S101, the roll-up direction to perform the roll-up operation and the sheet type information of the sheet as the conveyance target are confirmed. A rotation force to be set, which is linked with the confirmed roll-up direction and sheet type information, is obtained by referring to a table, and various kinds of control setting values are expanded in a variable area. An example of the table is a control setting table shown in FIG. 11.

In FIG. 11, the sheet roll-up directions are set as classifications for each sheet type information. The synchronous control mode or asynchronous control mode as the operation mode of the roll control unit, the reference roll-up rotation force setting value (reference driving force), the lock canceling rotation force setting value (canceling driving force), and the reference standby rotation force setting value (standby driving force) are linked with each sheet type information and each roll-up direction. In the example of the control setting table shown in FIG. 11, the asynchronous control mode is selected for sheet type information 1, and the synchronous control mode is selected for sheet type information 2. Sheet type information 1 represents a somewhat thin sheet with a relatively low stiffness as an example. In this setting example, a smaller rotation force is used for outer roll-up, and a larger rotation force is used for inner roll-up. Resultant driving has been described with reference to FIG. 5 of the second embodiment. In the outer roll-up, it is assumed that an excessive rotation force is unnecessary, and the lock state does not occur. Hence, both the lock canceling rotation force setting value and the reference standby rotation force setting value are 0, and accordingly, the rotation force in controlling the target is also selected to be 0.

On the other hand, in the inner roll-up, a load variation may occur due to curling. Hence, nonzero values are selected as a lock canceling rotation force setting value E and a reference standby rotation force setting value F. Note that arbitrary values that are not 0 are set to E and F. As the reference roll-up rotation force setting value, a large rotation force is needed in the inner roll-up operation. Hence, a value that meets a relationship given by reference roll-up rotation force setting value A<reference roll-up rotation force setting value D is set.

In sheet type information 2, the synchronous control mode is selected. A rotation force is always generated under this sheet type condition. Hence, nonzero values are set to all the reference roll-up rotation force setting value, the lock canceling rotation force setting value, and the reference standby rotation force setting value. Generally, in the inner roll-up operation, values larger than in the outer roll-up operation are set to cope with the load variation. Such sheet type information is set for each sheet type to reflect control according to the sheet properties.

Referring back to FIG. 10, according to the setting values in sheet information confirmation of step S101, roll motor driving selection is executed in step S102 to expand actual control variables. A control mode selection flag is set, and a rotation force to be finally reflected is decided in consideration of the sheet width information and the sheet diameter information in the current roll sheet state and expanded in the variable area.

After the roll motor driving selection execution of step S102, roll motor driving start is executed in step S103 to perform the roll-up operation. First, in step S104, a roll motor roll-up operation is performed to relax a roll slack in an offline state. When the roll-up operation (step S104) ends, an excess slack is removed from the roll sheet 14 existing between the conveyance roller pair 3 and the roll-up mechanical unit 7*a* or 7*b*, and preparation for a stable roll-up operation is completed.

Note that an example of a function required of the roll-up apparatus is a function of starting the roll-up operation during driving of the conveyance roller pair 3. In this case, processing cannot wait for completion of roll-up of the roll motor 16. Hence, the roll-up operation may be canceled to continue conveyance driving. This control is selectively performed in accordance with the overall operation of the printer, and the waiting for the roll-up operation of the roll motor 16 is not uniquely defined.

After the end of the roll motor roll-up operation of step S104, conveyance motor conveyance driving is executed in step S105. The conveyance roller pair 3 conveys the sheet to the position immediately under the carrier. After the conveyance motor conveyance driving execution of step S105, the sheet immediately under the carrier stops in step S106. The carrier is driven in a direction perpendicular to the sheet to start printing. This printing corresponds to carrier driving printing execution (step S106). At the same time as the carrier driving printing execution of step S106, in the asynchronous control mode, the roll-up operation by the roll motor is executed. Before the roll-up operation, the rotation force is updated to a rotation force considering the latest sheet diameter information in step S107. This is rotation force updating. Using the latest rotation force setting by the rotation force updating of step S107 as the upper limit of the rotation force, in step S108, the roll motor roll-up operation is executed to perform the roll-up operation. In the roll motor roll-up operation execution of step S108, after it is determined that the roll motor driving stops, the process transits to roll motor standby driving execution of step S109. This has been described as the status transition of waveforms shown in FIGS. 4 and 5. Upon transition to the roll motor standby driving execution of step S109, if it is determined that the roll motor is driven in accordance with the driving amount of the conveyance motor, sheet diameter updating is performed in step S110. After the carrier driving printing execution of step S106, it is determined in print job end of step S111 whether all the print data has ended. If the print data has ended, roll motor driving is stopped in step S112 to end printing. On the other hand, if the print data remains, conveyance motor conveyance driving is executed in step S105 to continue printing.

In the rotation force updating of step S107, it may be detected that the roll sheet 14 was in the lock state in the previous roll motor roll-up operation execution (step S108), and a setting to enable a lock canceling operation may be included in the lock canceling rotation force setting. In this case, the rotation force is set to a value obtained by adding the lock canceling rotation force setting to the reference rotation force setting, and the lock canceling operation is performed. This has been described with reference to FIG. 8.

Note that when the synchronous control mode is set as the operation condition, the rotation force setting of step S107 is performed before the conveyance motor driving execution (step S105), and the conveyance motor driving execution (step S105) and the roll motor roll-up driving execution (step S108) are simultaneously executed. This has been described with reference to FIG. 6.

When the roll-up driving described with reference to FIGS. 4 to 11 is implemented in this way, it is possible to perform a stable roll-up operation while applying a minimum necessary tension regardless of a load variation that occurs in the roll-up mechanical unit or due to curling or a sheet physical property variation that changes depending on the stiffness or thickness. A sheet stress is reduced while stabilizing the slack of the roll sheet within a predetermined range, and these effects are implemented by a simple apparatus arrangement, thereby implementing downsizing and improving image quality.

Fifth Embodiment

Figure 12:
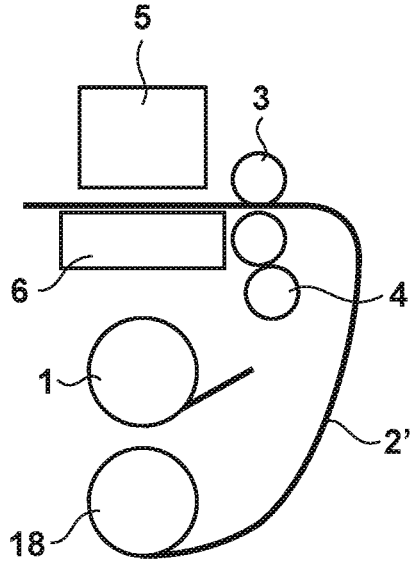
FIG. 12 is a schematic sectional view of an inkjet printer including a feed/roll-up mechanism according to the fifth embodiment.

As the fifth embodiment, there is a printing apparatus arrangement in which the roll-up mechanical units 7*a* and 7*b* according to the first and second embodiments of the present invention described with reference to FIGS. 1 and 3 also serve as a feed mechanical unit. FIG. 12 is a schematic sectional view of an inkjet printer as an example in which the roll-up mechanical unit is used as a second feed mechanical unit 18. Here, the second feed mechanical unit 18 is provided under a feed mechanical unit 1, and a different roll sheet 14 is guided to a conveyance roller pair 3 via a different feed path 2'.

For example, if a print setting instructs to use the roll-up mechanical unit of the second feed mechanical unit 18 as a roll-up function, the roll-up operation of the roll sheet 14 is performed by the method described in the first embodiment. On the other hand, if an instruction to use the roll-up mechanical unit of the second feed mechanical unit 18 as a feed function is issued, the second feed mechanical unit 18 controls a tension generated on the upstream side of the conveyance roller pair 3.

When performing printing while making the conveyance roller pair 3 convey the roll sheet 14, the second feed mechanical unit 18 controls the rotation force of a roll motor 16 so as to apply an appropriate tension to the roll sheet 14 existing between the second feed mechanical unit 18 and the conveyance roller pair 3. Hence, desired image quality can be implemented.

This embodiment is close to the concept of the synchronous control mode described with reference to FIG. 6. The rotation force of the roll motor 16 is generated in a direction reverse to that in the third embodiment shown in FIG. 6, and the tension per unit time is also generated in a reverse unroll direction. According to the driving state of the conveyance roller pair 3, the rotation force setting value at the time of brake driving in the second feed mechanical unit 18 is decided based on the setting of the roll control unit. When the conveyance roller pair 3 is at rest, the rotation force setting value is decided based on the setting of the roll control unit at the time of roll-up driving. The rotation forces are set by the roll control unit. Settings different from the rotation force settings of the roll-up mechanical unit are done. Both settings are unique and different from those on the roll-up side. The rotation force setting is done in consideration of feed conditions. Control is appropriately performed to make the tension per unit time of the conveyance roller pair 3 even based on the sheet type information and sheet width information of the roll sheet 14 and sheet diameter information that changes over time.

As described above, the present invention implements a stable roll-up operation regardless of various kinds of sheet types to print or a load variation condition by the roll-up condition of the roll-up apparatus. In addition, a tension is stably applied while reducing a stress on the sheet, thereby improving image quality. Furthermore, a simple apparatus arrangement can be implemented without making the apparatus arrangement bulky. Hence, an apparatus arrangement in which the roll motor serving as the driving source of the roll sheet is used as a roll-up mechanism that adjusts the tension to be applied to the conveyance motor is implemented. Moreover, tension control for the roll sheet is set individually in accordance with the sheet type or a roll-up setting (an inner roll-up operation and an outer roll-up operation), thereby implementing a roll-up apparatus with minimum necessary tension application to the roll sheet.

According to the present invention, tension control for the roll sheet is set individually in accordance with outer roll-up/inner roll-up, the sheet type, and the like, thereby implementing a roll-up apparatus with minimum necessary tension application to the roll sheet. Additionally, when the roll motor serving as the driving source of the roll unit is used as the roll-up mechanism that adjusts the tension to be applied to the roll sheet, a roll-up apparatus can be implemented by a simple arrangement that does not need a special tension application mechanism. It is also possible to provide a printing apparatus that performs roll motor control by selecting the feed mechanism or the roll-up mechanism and thus setting an appropriate value.

According to the present invention, it is possible to perform a stable roll-up operation by a simple arrangement.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-180114, filed Sep. 11, 2015, which is hereby incorporated by reference wherein in its entirety.

What is claimed is:

1. A printing apparatus comprising:

a printing unit configured to perform printing on a continuous sheet;

a conveyance unit configured to convey the continuous sheet;

a roll-up unit configured to roll up the continuous sheet printed by the printed unit wherein a tension is applied to the continuous sheet between the conveyance unit and the roll-up unit in accordance with a driving force of the roll-up unit; and a control unit configured to control the roll-up unit to execute a plurality of modes including (a) an inner roll-up mode in which the roll-up unit rolls up the continuous sheet by rotating in a first rotational direction such that a printed surface of the continuous sheet printed by the printing unit faces inward, and (b) an outer roll-up mode in which the roll-up unit rolls up the continuous sheet by rotating in a second rotational direction that is opposite to the first rotational direction such that the printed surface faces outward, wherein the driving force of the roll-up unit in the inner roll-up mode is greater than the driving force in the outer roll-up mode.

2. The apparatus according to claim 1, wherein a driving force for a roll of the continuous sheet having a first sheet width is greater than a driving force for a roll of the continuous sheet having a second sheet width that is smaller than the first sheet width.

3. The apparatus according to claim 1, wherein a driving force for a roll of the continuous sheet having a first roll diameter is larger than a driving force for a roll of the continuous sheet having a second roll diameter that is smaller than the first roll diameter.

4. The apparatus according to claim 1, wherein the conveyance unit repeats conveyance and stop of the continuous sheet for serial printing, and the control unit controls the roll-up unit to generate the tension without synchronism with the conveyance of the conveyance unit.

5. A printing apparatus comprising:

a printing unit configured to perform printing on a continuous sheet;

a conveyance unit configured to convey the continuous sheet for serial printing;

a roll-up unit configured to roll up the continuous sheet printed by the printing unit, wherein a tension is applied to the continuous sheet between the conveyance unit and the roll-up unit in accordance with a driving force of the roll-up unit; and a control unit configured to control the roll-up unit to execute one of (a) a synchronous control mode to drive the roll-up unit in synchronism with a conveyance of the conveyance unit, and (b) an asynchronous control mode to drive the roll-up unit without synchronism with a conveyance of the conveyance unit, based on a sheet type of the continuous sheet.

6. The apparatus according to claim 5, wherein the conveyance unit comprises a conveyance roller and a motor serving as a driving source for the conveyance roller, and in the asynchronous control mode, the control unit starts driving the roll-up unit upon detecting one of a stop of driving of the motor and a slack not less than a predetermined amount in the continuous sheet between the conveyance roller and the roll-up unit.

7. The apparatus according to claim 5, wherein the conveyance unit repeats conveyance and stop of the continuous sheet for the serial printing, and the control unit causes the roll-up unit to execute the asynchronous control mode that starts rotation with a delay from a start of the conveyance of the conveyance unit and then switches to a standby driving and, to execute the synchronous control mode that starts the rotation driving in synchronism with the start of the conveyance of the conveyance unit and then switches to the standby driving.

8. A printing apparatus comprising:

a printing unit configured to perform printing on a continuous sheet;

a conveyance unit configured to convey the continuous sheet intermittently for serial printing;

a roll-up unit configured to roll up the continuous sheet printed by the printing unit, wherein a tension is applied to the continuous sheet between the conveyance unit and the roll-up unit in accordance with a driving force of the roll-up unit; and a control unit configured to control the driving force of the roll-up unit; and a detection unit configured to detect a lock state of rotation of the roll-up unit in which the roll-unit is unable to move when the roll-up unit is driven with the driving force, wherein the control unit updates the driving force to be increased in a case where the detection unit detects the lock state of rotation.

9. The apparatus according to claim 8, wherein the detection unit counts a number of occurrence of the lock state, and the control unit sets the driving force based on the number.

10. The apparatus according to claim 9, wherein in a case where the number exceeds a predetermined value, the control unit interrupts updating of the driving force.

11. The apparatus according to claim 8, wherein the driving force is set based on at least one of a sheet width of the continuous sheet and a roll diameter of a roll of the continuous sheet.

12. The apparatus according to claim 8, wherein the conveyance unit repeats conveyance and stop of the continuous sheet for the serial printing, and the control unit controls the roll-up unit to generate the tension without synchronism with the conveyance of the conveyance unit.

* * * * *